US012000144B2

(12) United States Patent
Gosling et al.

(10) Patent No.: US 12,000,144 B2
(45) Date of Patent: Jun. 4, 2024

(54) MODULAR WALL SYSTEMS HAVING THICK AND THIN WALLS

(71) Applicant: DIRTT ENVIRONMENTAL SOLUTIONS LTD., Calgary (CA)

(72) Inventors: Geoff W. Gosling, Calgary (CA); Colin V. Blehm, Calgary (CA); Thomas A. Brown, Calgary (CA); Taylor W. Merchant, Calgary (CA)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 196 days.

(21) Appl. No.: 17/312,895

(22) PCT Filed: Feb. 12, 2020

(86) PCT No.: PCT/US2020/017924

§ 371 (c)(1),
(2) Date: Jun. 10, 2021

(87) PCT Pub. No.: WO2020/167946

PCT Pub. Date: Aug. 20, 2020

(65) Prior Publication Data

US 2022/0025649 A1 Jan. 27, 2022

Related U.S. Application Data

(60) Provisional application No. 62/804,622, filed on Feb. 12, 2019.

(51) Int. Cl.
*E04B 2/74* (2006.01)
*E04B 2/78* (2006.01)

(52) U.S. Cl.
CPC ..... *E04B 2/7453* (2013.01); *E04B 2/78* (2013.01); *E04B 2002/7464* (2013.01); *E04B 2002/7488* (2013.01)

(58) Field of Classification Search
CPC .. E04B 2/7453; E04B 2/78; E04B 2002/7464; E04B 2002/7488; E04B 2002/7446; E04B 2/7433
See application file for complete search history.

(56) References Cited

U.S. PATENT DOCUMENTS 3,378,977 A * 4/1968 Vervloet ..... E05D 5/0215 52/656.1
3,436,887 A * 4/1969 Grossman ..... E04B 2/965 52/235
6,250,020 B1 * 6/2001 Shipman ..... E04B 2/7433 52/239

FOREIGN PATENT DOCUMENTS

| | | |
|---|---|---|
| CA | 2932170 | 8/2015 |
| DE | 2103502 | 12/1972 |
| WO | 2015/188105 | 12/2015 |

OTHER PUBLICATIONS

International Preliminary Report on Patentability received for PCT Patent Application No. PCT/US2020/017924, dated Aug. 26, 2021, 11 pages.

(Continued)

*Primary Examiner* — Patrick J Maestri
(74) *Attorney, Agent, or Firm* — Workman Nydegger

(57) ABSTRACT

A pre-fabricated wall system that joins wall modules of different thicknesses can include a thin wall module having a depth defined by a distance from a front face thereof to a back face thereof, a thick wall module having a depth that is greater than the depth of the thin wall module, and a vertical connection post. The vertical connection post can include a first connection interface on a first side configured to secure to the thin wall module and a second connection interface on a second side opposite the first side configured to secure to the thick wall module. The thin wall module and the thick wall module can be arranged parallel or co-planar (Continued)

to None another when both the thin wall module and the thick wall module are secured to the vertical connection post.

18 Claims, 9 Drawing Sheets

(56) References Cited

OTHER PUBLICATIONS

International Search Report and Written Opinion received for PCT Patent Application No. PCT/US2020/017924, dated May 28, 2020, 17 pages.

* cited by examiner

MODULAR WALL SYSTEMS HAVING THICK AND THIN WALLS

CROSS-REFERENCE TO RELATED APPLICATIONS

This application is a 371 US nationalization of PCT Patent Application No. PCT/US2020/017924, filed Feb. 12, 2020, which claims priority to U.S. provisional patent application No. 62/804,622, filed Feb. 12, 2019. The entire content of the aforementioned patent applications is incorporated herein by reference.

BACKGROUND

Technical Field

The present invention relates generally to systems, methods, and apparatus for forming, assembling, and installing pre-fabricated wall systems. More specifically, the present invention relates to connection apparatus for pre-fabricated wall systems comprising thick and thin wall modules.

Background and Relevant Art

Office space can be relatively expensive, not only due to the basic costs of the location and size of the office space, but also due to any construction needed to configure the office space in a particular way. Furthermore, as an organization's needs change, the organization may need to have a convenient and efficient means to reconfigure the existing office space rather than having to move to a new office space. Many organizations address their configuration and reconfiguration issues by dividing large, open office spaces into individual work areas using pre-fabricated wall systems.

Pre-fabricated wall systems, including modular wall systems, are relatively easy to configure and/or reconfigure and can be less expensive to set up than more permanently constructed office dividers. Manufacturers or designers typically design such pre-fabricated walls and partitions to include a series of individual wall sections or modules (often including one or more wall tiles that are surrounded by vertical and horizontal end frames) that can be assembled together to form a range of different configurations. These wall modules/sections are usually connected to one or more structural components that form a frame-type structure of the pre-fabricated wall.

The individual wall modules that make up pre-fabricated wall systems often vary in height, length, thickness, and materials. For example, some wall systems may include thin wall sections (or "modules") that include thin wall tiles that are formed as solid pieces of material and surrounded by thin end frames. Thin sections or modules may provide various benefits, such as saving space, saving on materials, and/or providing a pleasing, sleek aesthetic. Other wall systems may include thick wall sections or modules that are constructed of multiple wall tiles that are spaced apart and surrounded by thick end frames to form an interior space within the module. Thick wall sections/modules with interior spaces may be advantageous to run electrical wiring, other utility lines, and/or accommodate other pre-fabricated wall system components, such as frame components.

Many environments exist in which users desire both thin sections/modules and thick sections/modules within the same pre-fabricated wall structure. However, manufacturers and installers may find it difficult to form pre-fabricated wall systems that include differently sized wall sections/modules, including both thin and thick modules as mentioned above. For instance, manufacturers and installers often find difficulty in creating structures to join modules of various thicknesses and sizes together within a single pre-fabricated wall system. These difficulties are exacerbated by the nearly limitless combinations of different modules that may be required to form uniquely partitioned spaces and customized aesthetic appearances of pre-fabricated wall systems.

Additionally, pre-fabricated wall system users often desire, for aesthetic or other purposes, to divide interior spaces with wall modules that include only a single thin wall tile (or a vertical arrangement of thin wall tiles). Simultaneously, however, pre-fabricated wall system users often need at least some thick wall modules implemented into their pre-fabricated wall systems for structural and/or practical purposes (e.g., to provide a space for utility lines within the wall modules). The need to accommodate connection to thick wall modules in a pre-fabricated wall system can constrain the minimum thickness for the end frames used in the wall modules of the pre-fabricated wall system.

Thus, in many pre-fabricated wall systems, the end frames of wall modules that house single thin wall tiles are as thick as the end frames of thick wall modules (e.g., 4 inches thick or larger). As such, many wall modules that house a single thin wall tile in pre-fabricated wall systems have a large disparity between the depth of the single wall tile (e.g., with a thickness of 1 inch or less) and the thickness of the end frames surrounding the single wall tile (e.g., 4 inches in thickness). The foregoing arrangement of thin wall tiles with thick end frames may be aesthetically disadvantageous, particularly when several thin wall tiles are arranged adjacently and/or in close proximity within the pre-fabricated wall system.

Accordingly, there are a number of problems in the field of pre-fabricated wall systems that need to be addressed.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Implementations of the present invention extend to systems, methods, and apparatus for forming, assembling, and installing pre-fabricated wall systems. More specifically, the present invention relates to connection apparatus for pre-fabricated wall systems comprising thick and thin wall modules. For example, at least one embodiment comprises a thin wall module, a thick wall module, and a vertical connection post with connection interfaces configured for securing to the thick wall module and the thin wall module. In at least one embodiment, the thick wall module and the thin wall module are arranged parallel or co-planar to one another when secured to the vertical connection post. In at least another embodiment, the thick wall module and the thin wall module are arranged non-parallel to one another when secured to the vertical connection post. The embodiments disclosed and claimed herein provide pre-fabricated wall systems that can integrate the utility/stability of thick wall modules with the aesthetic features of thin wall modules within the same pre-fabricated wall system, thereby capturing the benefits of both thin wall modules and thick wall modules.

For example, a pre-fabricated wall system that joins wall modules of different thicknesses can include a thin wall module having a depth defined by a distance from a front face thereof to a back face thereof, a thick wall module having a depth that is greater than the depth of the thin wall module, and a vertical connection post. The vertical connection post can include a first connection interface on a first side configured to secure to the thin wall module and a second connection interface on a second side opposite the first side configured to secure to the thick wall module. The thin wall module and the thick wall module can be arranged parallel or co-planar to one another when both the thin wall module and the thick wall module are secured to the vertical connection post.

In addition, a pre-fabricated wall system that joins walls of different thicknesses can include a thin wall module having a depth defined by a distance from a front face thereof to a back face thereof, a thick wall module having a depth that is greater than the depth of the thin wall module, and a vertical connection post. The vertical connection post can include a first connection interface on a first side configured to secure to the thin wall module and a second connection interface on a second side configured to secure to the thick wall module. The thin wall module and the thick wall module can be arranged non-parallel to one another when both the thin wall module and the thick wall module are secured to the vertical connection post.

Furthermore, a pre-fabricated wall system can include a plurality of wall modules. A thickness of each of the wall modules is defined by a distance between a front face of each wall module and a back face of each wall module. At least two of the plurality of wall modules have different thicknesses. The pre-fabricated wall system can further include a vertical connection post that has a plurality of connection interfaces configured for securing to each of the plurality of wall modules, including at least two of the plurality of wall modules that have different thicknesses.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Implementations of the present invention extend to systems, methods, and apparatus for forming, assembling, and/or installing pre-fabricated wall systems. More specifically, the present invention relates to pre-fabricated wall systems configured for including both thick wall modules and thin wall modules. For example, in one implementation of the present disclosure, a pre-fabricated wall system that joins wall modules of different thicknesses can include a thin wall module having a depth defined by a distance from a front face thereof to a back face thereof, a thick wall module having a depth that is greater than the depth of the thin wall module, and a vertical connection post. The vertical connection post can include a first connection interface on a first side configured to secure to the thin wall module and a second connection interface on a second side opposite the first side configured to secure to the thick wall module. The thin wall module and the thick wall module can be arranged parallel or co-planar to one another when both the thin wall module and the thick wall module are secured to the vertical connection post.

One aspect of at least some of the disclosed embodiments is to provide thin wall modules with thin end frames that may house a single thin wall tile (or a vertical arrangement of thin wall tiles) and that are further configurable to join with thick wall modules (e.g., via a vertical connection post 300, see FIGS. 3A-3D) within a pre-fabricated wall system. Pre-fabricated wall systems that allow for joining wall modules that have end frames with different thicknesses (e.g., thin end frames for thin wall modules that house a thin wall tile and thick end frames for thick wall modules that include an interior cavity) may avoid the aforementioned disparity in thickness between thin wall tiles and end frames that house the thin wall tiles. For example, the thin end frames of the thin wall modules that house thin wall tiles may have a thickness within a range of 1.5 inches to 2.75 inches.

The implementations of pre-fabricated wall systems described herein may solve a number of problems in the art, such as those noted above. For example, according to one or more implementations of the pre-fabricated wall systems described herein, users (e.g., manufacturers, designers, installers, business or residential property owners/occupiers, etc.) can utilize both thick wall modules and thin wall modules in a single pre-fabricated wall system to partition spaces. Enabling pre-fabricated wall systems to accommodate both thick wall modules and thin wall modules allows for pre-fabricated wall systems to versatilely, conveniently, and simultaneously provide benefits associated with thin wall modules (e.g., saving space/materials, aesthetic sleekness) and benefits associated with thick wall modules (e.g., insulation, providing a space for utility lines, privacy/security) within the same pre-fabricated wall structure.

Figure 1:
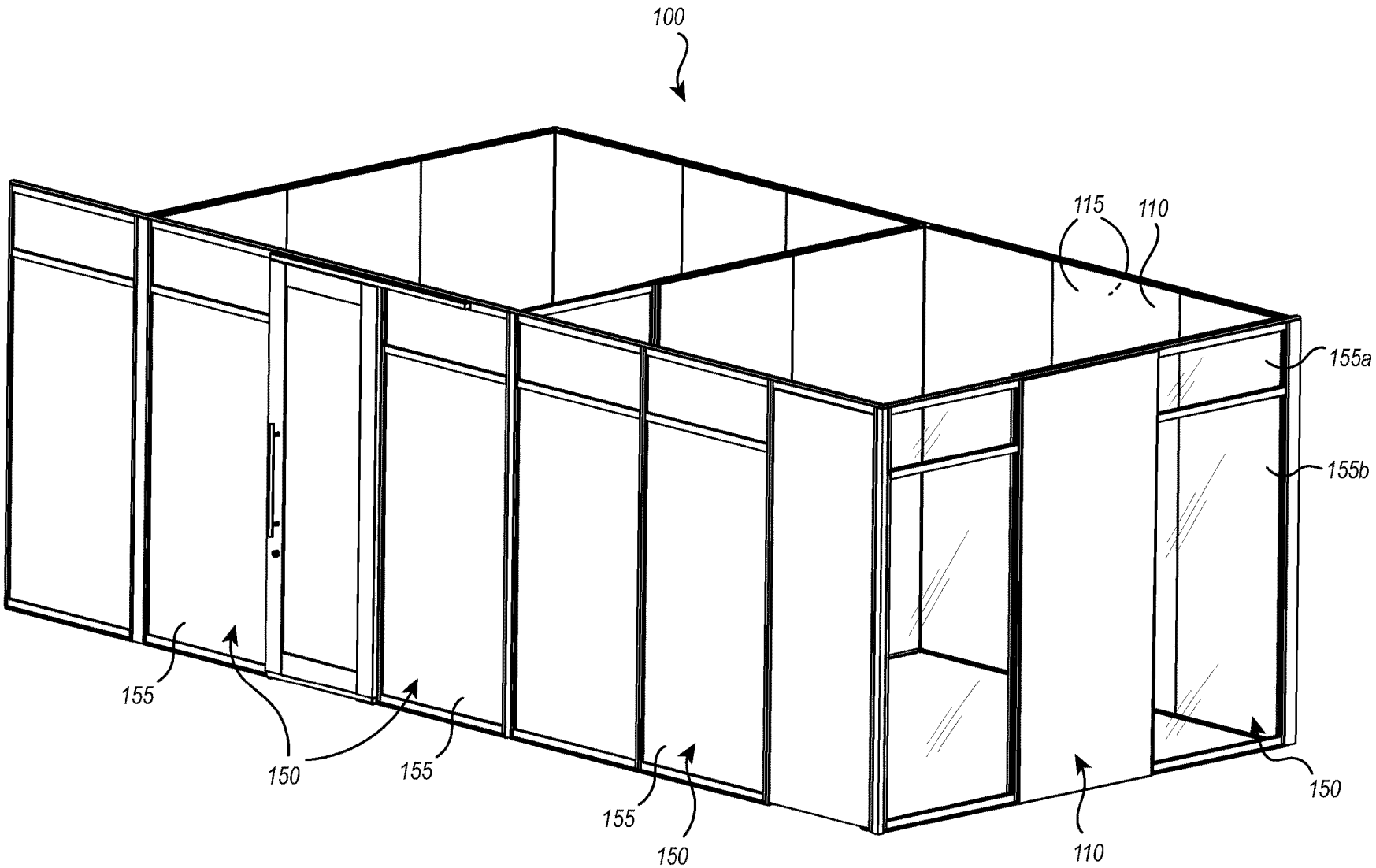
FIG. 1 illustrates a perspective view of a pre-fabricated wall system including both thick and thin wall modules, in accordance with implementations of the present disclosure.

FIG. 1 illustrates a perspective view of an example of a pre-fabricated wall system 100 that includes thick wall modules 110 and thin wall modules 150. As used herein, the term "module" or "wall module" (e.g., 110, 150) refers to a definable section of a pre-fabricated wall comprising at least one vertical frame (e.g., 250, 350) and at least one horizontal frame/connection component (e.g., 205). In some cases, the module may refer to a section comprising at least two vertical frames jointed by at least two horizontal frames, as well as an attached at least one front tile/panel (or divider) (e.g., 155) and/or at least one rearward tile/panel (or divider) (e.g., 155). Accordingly, a modular or pre-fabricated wall system means a set of vertical and horizontal frames that may be prepared to specifications and frequently at least partly assembled offsite and assembled together onsite as a modular or pre-fabricated wall/wall system. The horizontal and vertical frame components, in turn, can comprise any number or composition of structurally suitable materials, including but not limited to aluminum, steel, iron, copper, resin, rubber, or composites thereof.

FIG. 1 shows that at least some of the thick wall modules 110 are arranged adjacent to thin wall modules 150, at least some of the thick wall modules 110 are arranged adjacent to thick wall modules 110, and at least some of the thin wall modules 150 are arranged adjacent to thin wall modules 150. According to the present disclosure, thick wall modules 110 may be joined to thin wall modules 150 via a vertical connection post, as illustrated and described herein with reference to FIGS. 3A-5.

FIG. 1 shows that the thick wall modules 110 have front and back wall tiles 115 affixed to frame components of the thick wall modules 110 (e.g., affixed to internal frame components). The thick wall modules 110 also include end frames for interfacing with and/or securing to other adjacent wall modules and/or structural components.

FIG. 1 also illustrates that the thin wall modules 150 include thin wall tiles 155 that are surrounded/secured by frame components, such as vertical or horizontal frame components. The implementations illustrated in FIG. 1 show that the thin wall tiles 155 of the thin wall modules 150 are surrounded by vertical end frames that enable the thin wall modules 150 to interface with and/or secure to other adjacent wall modules and/or structural components (e.g., vertical or horizontal frame components thereof).

FIG. 1 furthermore illustrates that wall tiles 155 of the wall modules 150 of the pre-fabricated wall system 100 may be dispose above or below one another. For instance, thin wall tiles 155*a* and 155*b* are vertically arranged to form a pre-fabricated thin wall module 150 that includes adjacently arranged thin wall tiles 155*a* and 155*b*. The vertically arranged wall tiles 155*a* and 155*b* may be separated by a horizontal connection component (e.g., horizontal connection component 205, see FIG. 2A).

The thickness of a wall module (e.g., thin wall module 150 or thick wall module 110), as used herein, may be defined as the distance between front and back faces of the wall module. However, one will recognize, in view of the present disclosure, that the front and/or back faces of a wall module may have different meanings, depending on the configuration of the wall module. For instance, the front and back faces of a wall module that includes multiple, opposing wall tiles arranged on frame components (e.g., the thick wall modules 110 shown in FIG. 1) may be defined as the outward-facing surfaces of the opposing wall tiles of the wall module. Accordingly, the thickness of such a wall module may be defined as the distance between the outward-facing surfaces of the opposing wall tiles of the wall module. In some embodiments, thick wall modules 110 have a thickness that is greater than 2.75 inches (e.g., within a range of 3 inches to 5 inches).

In other instances, the front and back faces of a wall module that includes only a single wall tile secured by surrounding end frames (e.g., the thin wall modules 150 shown in FIG. 1) may be defined as the outward-facing portions/surfaces of the end frames themselves. Accordingly, the thickness of such a wall module may be defined as the thickness of the end frames that surround the single wall tile. In some embodiments, thin wall modules 150 have a thickness that is less than or equal to 2.75 inches (e.g., within a range of 1.5 inches to 2.75 inches).

Put differently, the thickness of a wall module, as used herein, may be defined as the distance between the opposing outmost faces of the wall module, whether the opposing outmost faces be surfaces of opposing wall tiles or opposing surfaces of end frames.

The wall tiles 115, 155 illustrated in FIG. 1 may be composed of numerous materials, such as solid glass, plastics/polymers, metals (e.g., sheet metals), wood/paper products, composites, felt and textile fabrics (e.g., as a facing/finishing/barrier material) and/or any other suitable material or combination thereof.

The thin wall modules 150 shown in FIG. 1 demonstrate that a wall module of a pre-fabricated wall system may include a thin wall tile (e.g., wall tiles 155), and the wall tile may be thin in depth (e.g., 1 inch or less in depth). One will appreciate, in view of the present disclosure, that a thick wall module 110 is also configurable to include only a thin wall tile secured between end frames of the thick wall module 110.

Figure 2A:
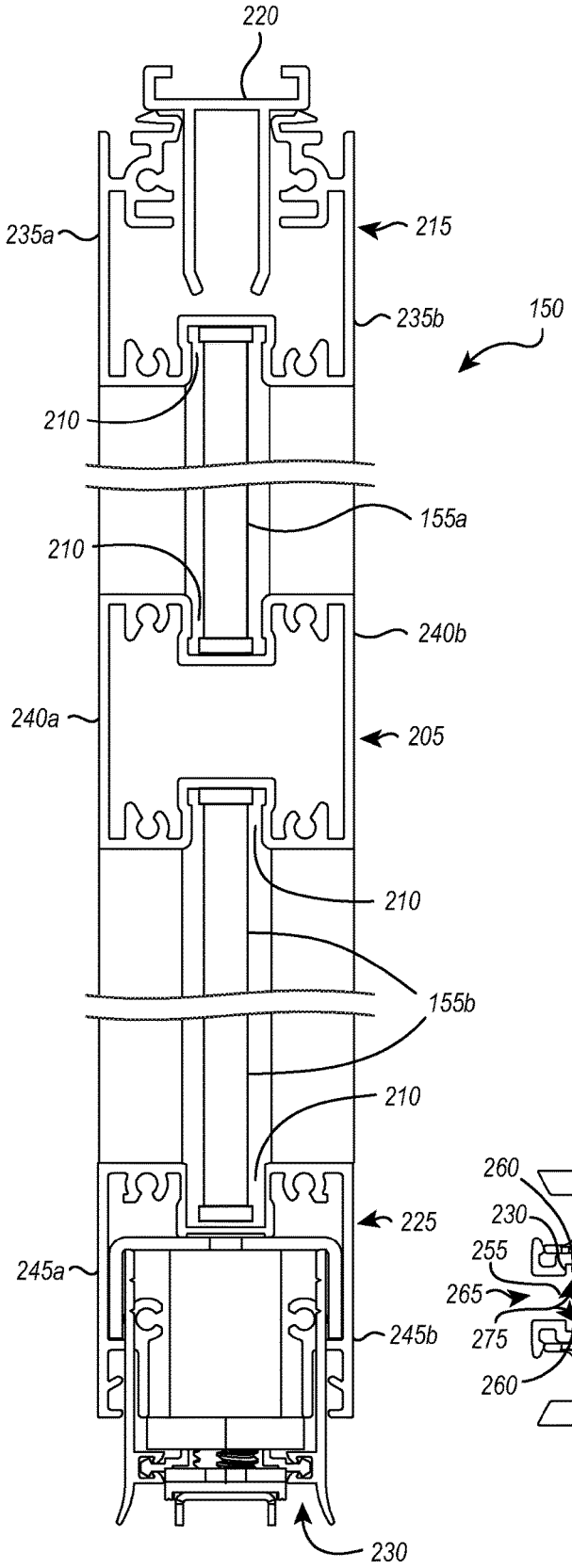
FIG. 2A illustrates a side sectioned view of components of a thin wall module, in accordance with implementations of the present disclosure.
Figure 2B:
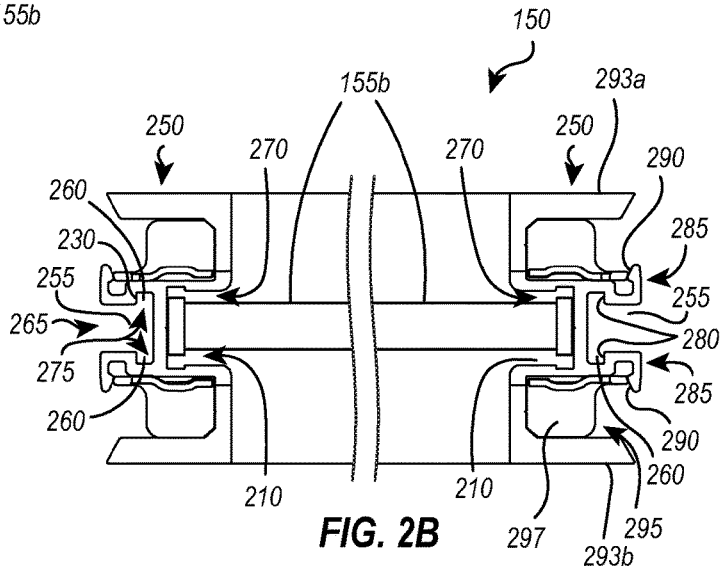
FIG. 2B illustrates a top sectioned view of components of a thin wall module, in accordance with implementations of the present disclosure.

FIGS. 2A and 2B illustrate additional details concerning the thin wall modules 150 that include thin wall tiles 155 surrounded by end frames. One will recognize, however, that thin wall modules may alternatively include front and back wall tiles affixed to frame components and surrounded by end frames (e.g., similar to the thick wall modules 110).

FIGS. 2A and 2B illustrate, respectively, side and top sectional views of components of thin wall modules 150. In particular, FIG. 2A illustrates a side sectional view of a thin wall module 150 having a top thin wall tile 155*a* and a bottom thin wall tile 155*b*. As mentioned above, a horizontal connection component 205 may connect to both the top thin wall tile 155*a* and the bottom thin wall tile 155*b*. The horizontal connection component 205 illustrated in FIG. 2A includes channels 210 on opposing sides thereof for securing the thin wall tiles 155*a*, 155*b* (with friction fitting or other securing elements known in the art).

FIG. 2A also shows that the wall module 150 can include a ceiling interface component 215 and a floor interface component 225. The ceiling interface component 215 and the floor interface component 225 also include channels 210 for securing to the thin wall tiles 155*a*, 155*b*. In particular, the channel 210 of the ceiling interface component 215 secures a top edge of the top thin wall tile 155*a*, and the channel 210 of the floor interface component 225 secures a bottom edge of the bottom thin wall tile 155*b*.

In at least one embodiment, the ceiling interface component 215 extends along a top of the thin wall module 150 and may operate to secure the thin wall module 150 to a ceiling. For example, FIG. 2A shows that the ceiling interface component 215 accommodates an upper channel 220 for interfacing with a ceiling attachment clip or other attachment mechanism installed on a ceiling. Similarly, the floor interface component 225 extends along a bottom of the thin wall module 150 and may operate to secure the wall module to a floor. For instance, FIG. 2A shows that floor interface component 225 includes an adapting surface 230 for attaching to floor connection elements, such as attachment clips, carpet grippers, wall levelers, wall to floor flexible trim, and/or any attachment mechanisms known in the art.

FIG. 2B illustrates a top sectional view of the thin wall module 150 that shows thin wall tile 155*b* secured to and positioned between two vertical end frames 250. Similar to the ceiling interface component 215 and the floor interface component 225 shown in FIG. 2A, the vertical end frames 250 also include channels 210 for securing/connecting to opposing vertical edges/ends of the thin wall tile 155*b*. The vertical end frames 250 also include channels 255. The channels 255 are configured to align with corresponding channels of vertical connection posts of a pre-fabricated wall system (e.g., vertical connection post 300, see FIGS. 3A-3D) or with channels 255 of another vertical end frame of another thin wall module (e.g., an adjacently arranged thin wall module).

FIG. 2B shows that the channels 255 share a channel wall with the channels 210. The shared channel wall of the channels 255 and 210 is thinner than the channel depth of the channels 255, 210 (e.g., the distance between the channel openings 265, 270 and the shared channel wall). In some instances, the shared channel wall of the channels 255, 210 allows the structural supporting features of the vertical end frames 250 to be configured in a space-efficient manner, allowing the thickness and the width of the end frames 250 (and, consequently, the thin wall module 150) to be thinner than otherwise. The arrangement of the channels 255, 210 with a shared channel wall may also allow the thin wall modules 150 to be constructed in a manner that saves on the cost of materials, especially because the vertical end frames 250 may be constructed in a space-efficient manner.

The channels 255 also include anchoring channels 260 disposed within the interior of the channels 255. The anchoring channels shown in FIG. 2B are configured to receive anchor extensions 380 of a channel insert 375 (see, for example, FIG. 3B). FIG. 2B shows that the anchoring channels 260 are positioned on opposing channel walls of the channels 255 and extend in opposite directions from the channels 255. The anchoring channels 260 share a channel wall with the channels 255 and also share a channel wall with the channels 210. The shared channel wall configuration of the anchoring channels can allow for a compact arrangement of the structural support components of the vertical end frames 250. The compact arrangement of the vertical end frames 250 may also enable thin wall modules 150.

FIG. 2B illustrates that, in at least one embodiment, the width of the anchor channel openings 275 of the anchoring channels 260 can be thinner than a width of the of the channel openings 265 of the channels 255. FIG. 2B also illustrates that the width of the anchor channel openings 275 can be smaller than the distance between the channel openings 265 of the channels 255 and the first sidewalls 280 of the anchoring channels 260. In this regard, the anchoring channels 260 shown in FIG. 2B are compact in size while positioned deep enough within the channels 255 to provide support to a pre-fabricated wall system (e.g., pre-fabricated wall system 100) by receiving anchor extensions 380 of a channel insert 375 (see, for example, FIG. 3B).

One will appreciate, in view of the present disclosure, that a channel 255 may include any number of anchoring channels 260. For instance, in some examples, a channel 255 includes only a single anchoring channel 260 disposed on one sidewall of the channel 255. In other examples, a channel 255 includes multiple anchoring channels, such as two, or three or more anchoring channels 260 disposed on the sidewalls of the channel 255.

FIG. 2B further illustrates that the channels 255 can include one or more channel protrusions 285 extending from opposing sidewalls of the channels 255. In at least one embodiment, the channel protrusions 285 are configured to align with channel protrusions 285 of an adjacently arranged vertical end frame 250 (e.g., of an adjacently arranged thin wall module 150) and/or with corresponding channel protrusions 385 of a vertical connection post 300 (see, for example, FIGS. 3A-4B). The channel protrusions 285 can include one or more ledges or recesses 290 for interfacing with a connector 310 that secures a thin wall module 150 to an adjacently arranged thin wall module 150 or a vertical connection post 300 (see, for example, FIGS. 3A-4B).

The channel protrusions 285 may, in some implementations, extend away from the opposing sidewalls of the channels 255 in the same direction as the anchoring channels 260. For example, FIG. 2B illustrates the channel protrusions 285 and the anchoring channels 260 extending orthogonally away from the opposing sidewalls of the channels 255. Those skilled in the art will recognize, in view of the present disclosure, that a channel 255 may include any number of channel protrusions 285 extending therefrom. By way of non-limiting example, a channel 255 can include a single channel protrusion 285 extending from a sidewall of the channel 255 without a channel protrusion 285 on the opposing sidewall.

The thickness of the thin wall module 150, as noted above, is the distance between the opposing outmost faces of the thin wall module 150. In particular, the thickness of the thin wall module 150 is illustrated in FIG. 2A by the distance between opposing outward-facing faces of the ceiling interface component 215 (e.g., the distance between faces 235*a* and 235*b*), the horizontal connection component 205 (e.g., the distance between faces 240*a* and 240*b*), and the floor interface component 225 (e.g., the distance between faces 245*a* and 245*b*). Furthermore, the thickness of the thin wall module 150 is illustrated in FIG. 2B by the distance between opposing outward-facing faces of the vertical end frames 250 (e.g., the distance between faces 293*a* and 293*b*). In some instances, the thickness of the thin wall module 150 is within a range of 1.5 inches to 2.75 inches.

FIG. 2B also shows that the vertical end frames 250 may, in at least one implementation, include secondary channels 295 that can be filled with one or more acoustic fillers 297 to prevent sound and/or air from passing through the vertical end frame 250 at junctions between thin wall modules 150 and other thin wall modules 150 and/or vertical connection posts 300.

Figure 2C:
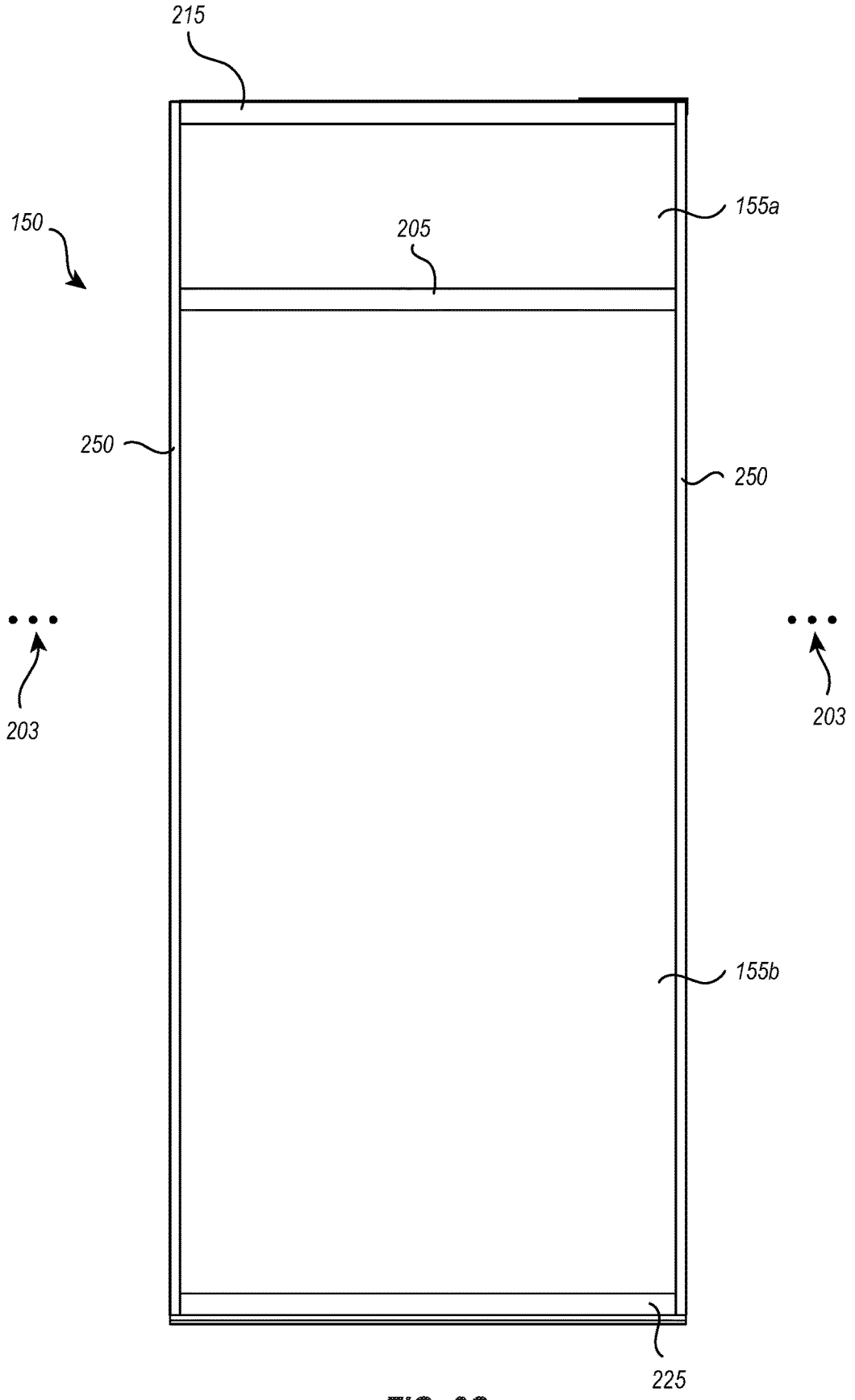
FIG. 2C illustrates a front facing view of a thin wall module and components thereof, in accordance with implementations of the present disclosure.

FIG. 2C illustrates a front facing view of a thin wall module 150. FIG. 2C illustrates that the ceiling interface component 215, the horizontal connection component 205, and the floor interface component 225 can connect to the vertical end frames 250 to form a frame structure for a pre-fabricated thin wall module 150. FIG. 2C also shows that the thin wall tile 155*a* can be surrounded and held in place by frame components (e.g., ceiling interface component 215, the horizontal connection component 205, and the vertical end frames 250). Similarly, FIG. 2C illustrates that thin wall tile 155*b* can be surrounded and held in place by frame components (e.g., floor interface component 225, the horizontal connection component 205, and the vertical end frames 250).

Additionally, FIG. 2C shows ellipses 203, indicating that the vertical end frames 250 of the thin wall module 150 can connect to the vertical end frames 250 of other thin wall frames 150 (see, for example, FIGS. 1 and 5) and/or connect to vertical connection posts 300 (see, e.g., FIGS. 3A-5). Similarly, those skilled in the art will appreciate, in view of the present disclosure, that vertical end frames 350 of thick wall panels 110 can connect to the vertical end frames 350 of other thick wall frames 110 (see, for example, FIGS. 1 and 5) and/or connect to vertical connection posts 300 (see, e.g., FIGS. 3A-5). The vertical connection posts 300 can enable both thin wall panels 150 and thick wall panels 110 to be installed and arranged within the same pre-fabricated wall system (e.g., pre-fabricated wall system 100).

FIGS. 3A-3D illustrate top views of various configurations of a thin wall module 150 and a thick wall module 110 joined together via a vertical connection post 300. The vertical connection post 300 can include at least one side 330 (e.g., 330*a* in FIG. 3A, 330*b* in FIG. 3B) that includes a connection interface 335 (e.g., 335*a* in FIG. 3A, 335*b* in FIG. 3B) that is configured for connecting to a thin wall module 150 and another side 340 (e.g., 340*a* in FIG. 3A, 340*b* in FIG. 3B) that includes a connection interface 345 (e.g., 345*a* in FIG. 3A, 345*b* in FIG. 3B) that is configured for connecting to a thick wall module 110.

Figure 3B:
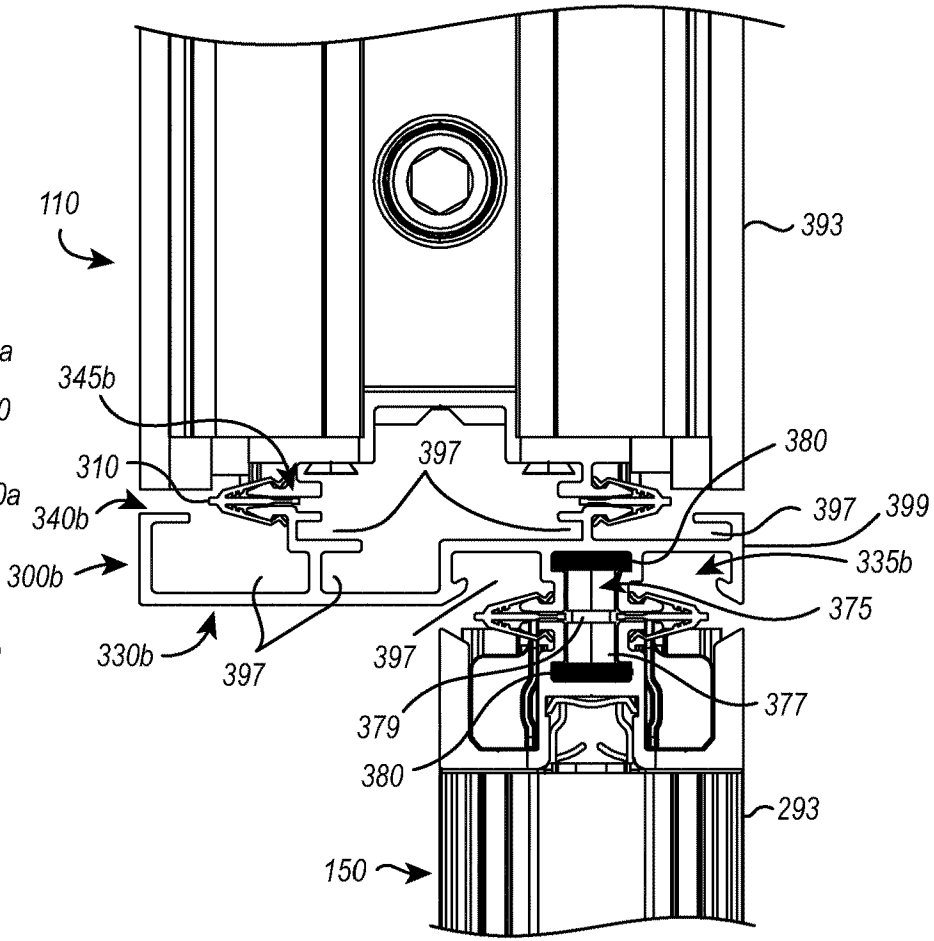
FIG. 3B illustrates a top view of a configuration of a thin wall module and a thick wall module arranged co-planar to one another in a pre-fabricated wall system, in accordance with implementations of the present disclosure.
Figure 3A:
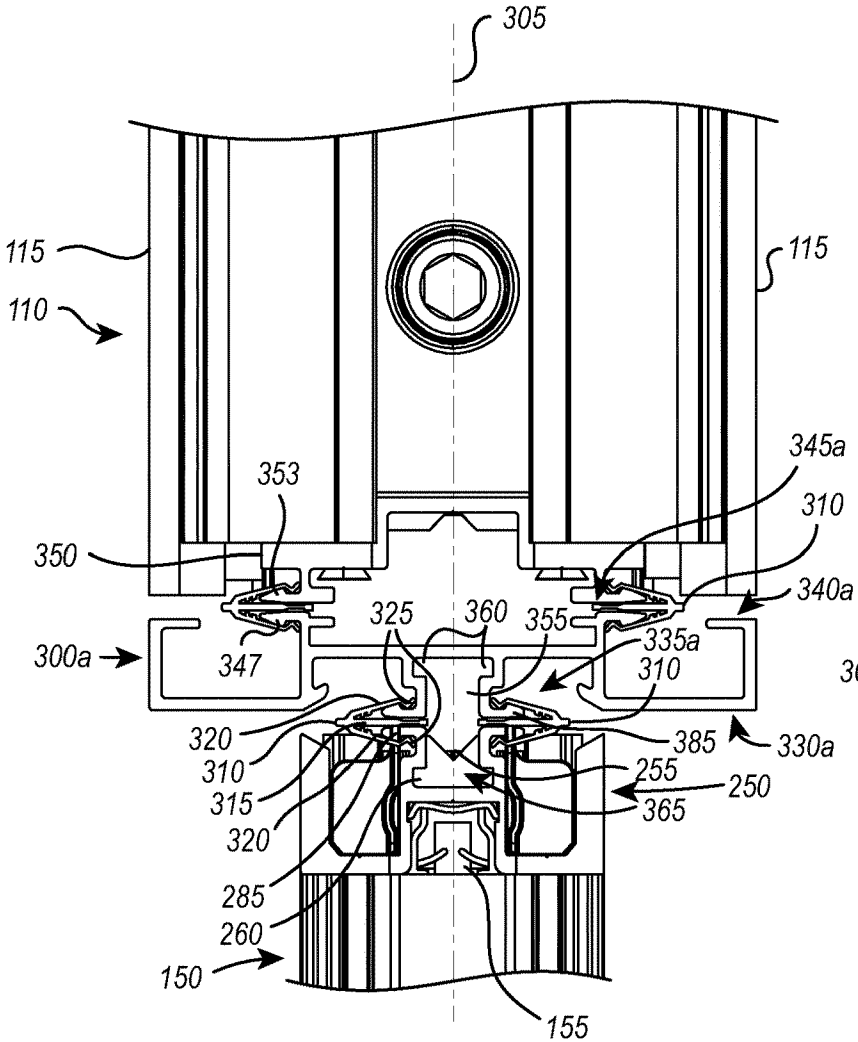
FIG. 3A illustrates a top view of a configuration of a thin wall module and a thick wall module arranged parallel and on center line to one another in a pre-fabricated wall system, in accordance with implementations of the present disclosure.

FIGS. 3A and 3B show configurations in which the thin wall module 150 and the thick wall module 110 become arranged parallel and on center line or co-planar to one another when both the thin wall module 150 and the thick wall module 110 are secured to the vertical connection post 300. For instance, FIG. 3A illustrates a configuration in which center planes 305 of both the thin wall module 150 and the thick wall module 110 are aligned when both the thin wall module 150 and the thick wall module 110 are secured to the vertical connection post 300*a*. The center planes 305 can pass through vertical centers of the vertical end frame 250 of the thin wall module 150, the vertical end frame 350 of the thick wall module 110, and the connection interfaces 335*a*, 345*a* of the vertical connection post 300*a* when the thin wall module 150 and the thick wall module 110 are secured to the vertical connection post 300*a*.

In another instance, FIG. 3B illustrates a configuration in which one face 293 of the thin wall module 150 and one face 393 of the thick wall module 110 are aligned when both the thin wall module 150 and the thick wall module 110 are secured to the vertical connection post 300*b*. The face 393 of the thick wall module 110 may further align with an outer face 399 of the vertical connection post 300*b*. Additionally, one will appreciate, in view of the present disclosure, that a vertical connection post 300 may secure on opposing sides 330, 340 thereof to a thin wall module 150 and a thick wall module 110 in a manner in which neither center planes 305 nor faces 293, 393 of the thin wall module 150 and/or the thick wall module 110 are aligned in the manner illustrated in FIGS. 3A and 3B.

FIGS. 3A and 3B also illustrate additional details concerning the connection interfaces 335, 345 of the vertical connection post 300 and the features thereof for connecting to both the thin wall module 150 and the thick wall module 110. In particular, FIGS. 3A and 3B show that the connection interface 335*a*, 335*b* includes a channel 355 that includes anchoring channels 360 and channel protrusions 385. The channel 355, the anchoring channels 360, and the channel protrusions 385 of the connection interface 335*a*, 335*b* can correspond to and/or mirror the channels 255, anchoring channels 260, and channel protrusions 285 of the vertical end frame 250 of the thin wall module 150. For instance, a user may arrange the vertical end frame 250 with the connection interface 335*a* such that the openings of the channels 255, 355 face one another as shown in FIG. 3A to form a cavity 365. The cavity 365 is composed of the channels 255, 355 and the anchoring channels 260, 360. The channel protrusions 285, 385 extend away from the cavity 365.

With the vertical end frame 250 arranged against the connection interface 335*a* as shown in FIG. 3A, a user may utilize one or more connection elements to secure the thin wall module 150 to the vertical connection post 300. For instance, FIG. 3A illustrates a connector 310 configured to secure the thin wall module 150 to the vertical connection post 300 by securing the channel protrusions 285 of the vertical end frame 250 to the channel protrusions 385 of the connection interface 335*a*. The connector 310, in some instances, includes a body portion 315 that has opposing arms 320 extending therefrom. The opposing arms 320 may include locking members 325 for engaging with the ledges or recesses of the channel protrusions 285, 385. A user may insert the body portion 315 of the connector 310 between the channel protrusions 285, 385 and may advance the locking members 325 of the connector 310 over and into engagement with the ledges or recesses of the channel protrusions 285, 385.

Although FIGS. 3A-3B illustrate the connector 310 as forming a substantially U-shaped structure with the body portion 315 extending therebetween, one will recognize that other configurations for the connector 310 are within the scope of this disclosure. For example, the connector 310 may comprise a V-shaped, C-shaped, W-shaped, Y-shaped, T-shaped, E-shaped, or other configuration.

Additionally, or alternatively, the cavity 365 formed by the channels 255 and 355 of the vertical end frame 250 and the connection interface 335, respectively, may receive a channel insert 375 configured to reside within the cavity 365. In some instances, utilizing both channel inserts 375 and connectors 310 to secure a thin wall module 150 to a vertical connection post 300 causes the connection between the thin wall module 150 and the vertical connection post 300 to have strong support against lateral forces that might be applied to the thin wall module 150, as well as sound and airflow seals between sides of the wall, when implemented into a pre-fabricated wall system. The combination of channel inserts 375 and connectors 310 may result in strong support for a pre-fabricated wall system while also allowing for the vertical end frames 250 of the thin wall modules 150 to have a small thickness (e.g., within a range of 1.5 inches to 2.75 inches).

The channel insert 375 can include an elongated body 377 that extends between the channels 255 and 355 of the vertical end frame 250 and the connection interface 335, respectively. The elongated body 377 can include a recessed portion 379 in a center thereof to accommodate the body portion 315 of connectors 310 when one or more connectors 310 are used in combination with a channel insert 375, as well as to provide a groove for orientation during installation of connectors 310, via interface with installation tools.

The channel insert 375 may also include anchor extensions 380 that are configured to reside within the anchoring channels 260, 360 of the channels 255, 355. The elongated body 377 may extend between the anchor extensions 380 with a length that is greater than the length of the channel openings 265, 270 described herein. The elongated nature of the channel insert 375 may allow the channel insert to extend deep enough into the vertical connection post 300 and the vertical end frame 250 to provide a connection therebetween that can withstand lateral forces applied against a pre-fabricated wall system, as well as maintain panel position relative to one another.

The channel insert 375 may operate to secure the thin wall module 150 to the vertical connection post 300 when a user inserts the channel insert 375 into the cavity 365 formed by the channels 255, 355 with the anchor extensions 380 extending into the anchoring channels 260, 360 of the channels 255, 355.

One will appreciate, in view of the present disclosure, that the channel insert 375 can include any number of anchor extensions 380 positioned variously along the elongated body 377 for insertion into any number of corresponding anchoring channels 260, 360 of the vertical end frame 250 and the connection interfaces 335.

FIGS. 3A-3B also illustrate that the connection interface 345 on the opposing side 340 of the vertical connection post 300 includes connection protrusions 347 that are configured to align with corresponding connection protrusions 353 of the vertical end frame 350 of the thick wall module 110. In some embodiments, users may use the same connector 310 described above (e.g., for securing the thin wall module 150 to the vertical connection post 300) to secure the thick wall module 110 to the vertical connection post 300 by advancing the connector 310 over the connection protrusions 347, 353. Thus, the connector 310 may be a versatile connector 310 that users may employ to connect both thick wall modules 110 and thin wall modules 150 to each other and to vertical connection posts 300.

Those skilled in the art will appreciate, in view of the present disclosure, that the vertical connection posts 300 described herein may comprise any suitable rigid material. In at least one embodiment, the vertical connection posts 300 comprise aluminum, which is strong and can be easily extruded to provide detailed features for attachments (e.g., connection interfaces 335, 345). FIGS. 3A and 3B show that the vertical connection posts can include additional channels or openings 397 that can receive an acoustic filler material. In at least one embodiment, the wall thicknesses of the vertical connection post 300 extrusions may be approximately 0.080" (2 mm) thick but may be somewhat thicker or thinner in specific locations or in specific implementations.

Figure 3C:
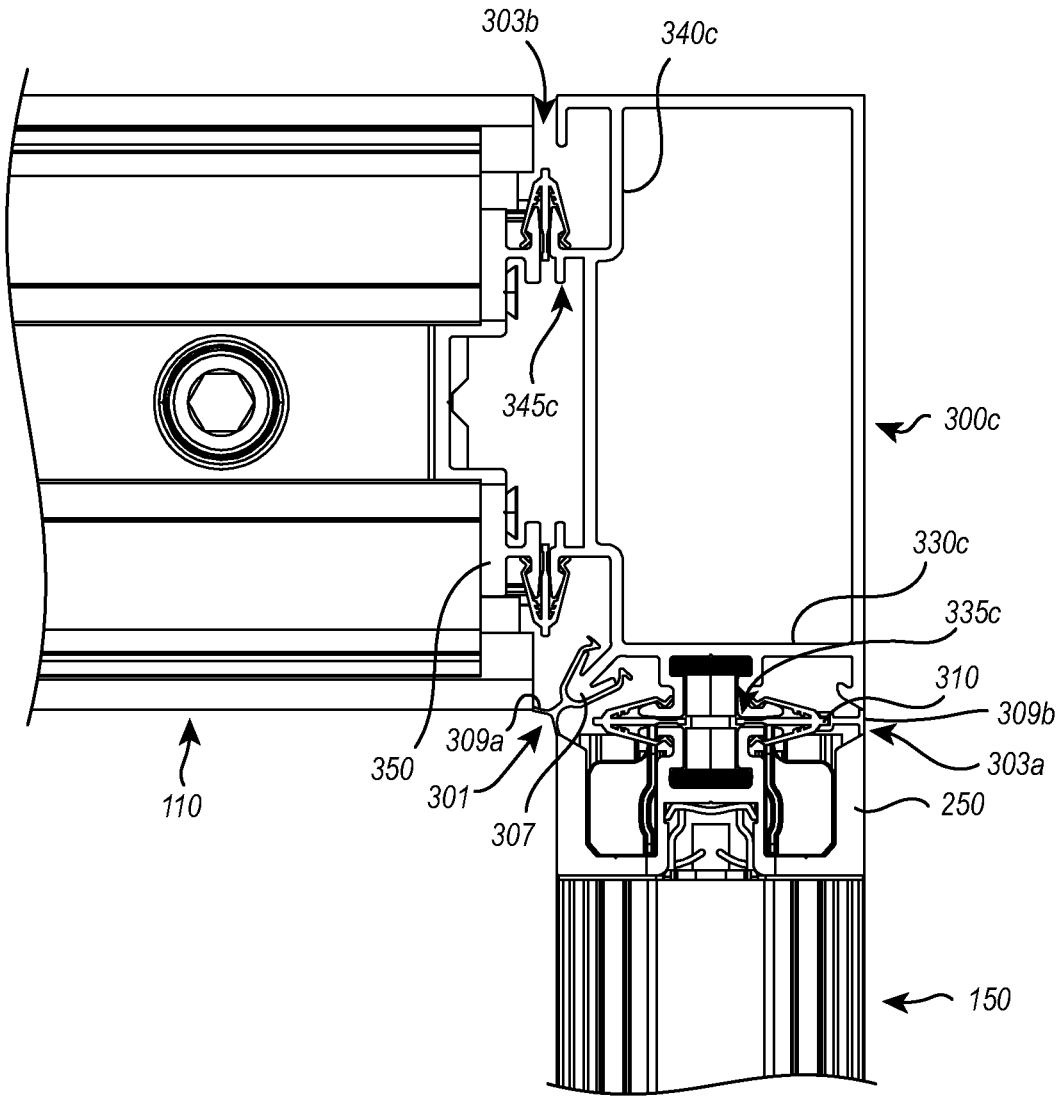
FIG. 3C illustrates a top view of a configuration of a thin wall module and a thick wall module arranged perpendicular to one another in a pre-fabricated wall system, in accordance with implementations of the present disclosure.

FIG. 3C illustrates an embodiment of a vertical connection post 300*c* configured for arranging a thin wall module 150 and a thick wall module 110 non-parallel to one another when both the thin wall module 150 and the thick wall module 110 are secured to the vertical connection post 300*c*.

FIG. 3C shows that the connection interface 335*c* for securing to the vertical end frame 250 of the thin wall module 150 is positioned on a side 330*c* of the vertical connection post 300*c* that is orthogonal to the side 340*c* of the vertical connection post 300*c* that includes the connection interface 345*c* for securing to the vertical end frame 350 of the thick wall module 110. In this regard, the thin wall module 150 and the thick wall module 110 form a right angle with respect to one another when both are secured to the vertical connection post 300*c*.

Many of the features and elements of the connection interfaces 335*c*, 345*c* and of the vertical end frames 250, 350 correspond to those shown with reference to FIGS. 3A and 3B (e.g., channels 255, 355, cavity 365, channel insert 375, channel protrusions 285, 385, connection protrusions 347, connectors 310, etc.). Accordingly, FIGS. 3C-4B omit reference to at least some of these features for clarity and/or simplicity.

FIG. 3C further illustrates that the vertical connection post 300*c* includes a corner protrusion 307 extending toward a space 301 formed between the thin wall module 150 and the thick wall module 110 when both the thin wall module 150 and the thick wall module 110 are secured to the vertical connection post 300*c*. In at least one embodiment, as FIG. 3C illustrates, the corner protrusion 307 is substantially arrow-shaped, with a body portion and two opposing arms extending therefrom. The corner protrusion 307 can receive a seal 309*a* that has a body portion with locking members extending therefrom that fit and secure over the opposing arms of the corner protrusion 307. The seal 309*a* can be formed of any suitable material (e.g., an elastic polymer) and can be configured to at least partially fill the space 301 or gap between the thin wall module 150 and the thick wall module 110 for aesthetic and/or functional purposes (e.g., to prevent air passage and/or to block sound, heat, dust, light, etc.)

FIG. 3C (as well as other Figures) illustrate a space 303*a* formed between the thin wall module 150 and the vertical connection post 300*c* when the thin wall module 150 is secured to the vertical connection post 300*c* and a space 303*b* formed between the thick wall module 110 and the vertical connection post 300*c* when the thick wall module 110 is secured to the vertical connection post 300*c*. FIG. 3C further illustrates that a connector 310 may include a seal 309*b* configured for filling the gap or space 303*a*, 303*b*. The seal 309*b*, in at least one implementation, includes a body portion with a channel extending therefrom for engaging with the body portion 315 of a connector 310, as FIG. 3C illustrates. In other instances, however, the seal 309*b* is integrally formed as a part of the connector 310.

One will appreciate, in view of the present disclosure, that a user may employ a seal 309*b* to seal a gap or space 303*a*, 303*b* formed between a wall module (e.g., a thin wall module 150 and/or a thick wall module 110) and a vertical connection post 300. Furthermore, one will appreciate that a user may employ a seal 309*b* to seal any gap or space formed between thin wall modules 150 that are connected to other adjacently arranged thin wall modules 150, as well as any gap or space formed between thick wall modules 110 that are connected to other adjacently arranged thick wall modules 110 (without a vertical connection post 300; see, for example, FIG. 5).

In addition, in one or more implementations of the present disclosure, the seals 309*a*, 309*b* are medical grade seals. Medical grade seals are those that prevent the flow of air, infectious materials, and/or other contaminants through an assembled pre-fabricated wall system sufficiently to meet hospital standards of cleanliness and/or sterilization. For example, medical grade seals may be used to form a wall system that creates a quarantine space or clean room environment.

Figure 3D:
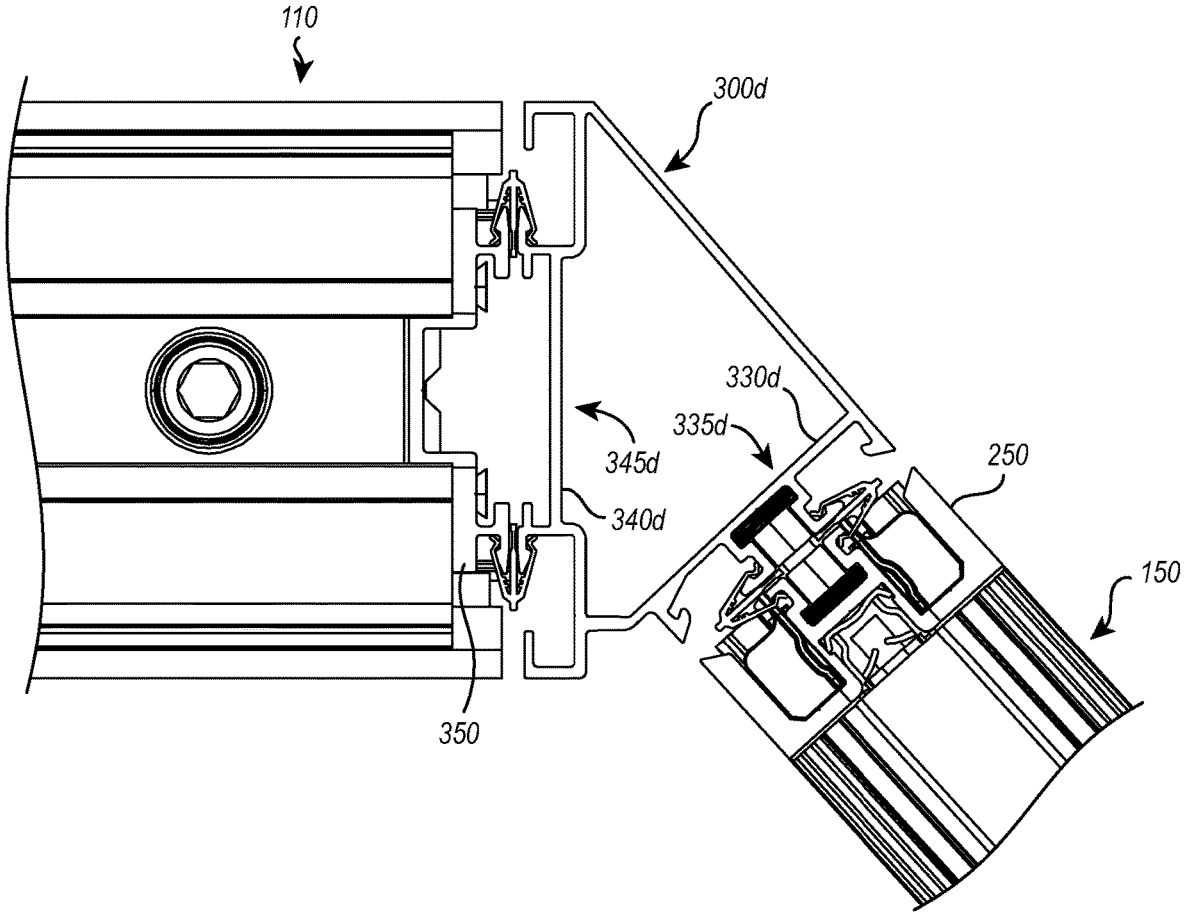
FIG. 3D illustrates a top view of a configuration of a thin wall module and a thick wall module arranged non-perpendicular and non-parallel to one another in a pre-fabricated wall system, in accordance with implementations of the present disclosure.

FIG. 3D also illustrates an embodiment of a vertical connection post 300*d* configured for arranging a thin wall module 150 and a thick wall module 110 non-parallel to one another when both the thin wall module 150 and the thick wall module 110 are secured to the vertical connection post 300*d*. In particular, FIG. 3D shows that the connection interface 335*d* for securing to the vertical end frame 250 of the thin wall module 150 is positioned on a side 330*d* of the vertical connection post 300*d* that is not orthogonal to the side 340*d* of the vertical connection post 300*d* that includes the connection interface 345*d* for securing to the vertical end frame 350 of the thick wall module 110. In this regard, the thin wall module 150 and the thick wall module 110 are not perpendicular or parallel to one another when both are secured to the vertical connection post 300*d*. Accordingly, in view of the present disclosure, those skilled in the art will appreciate that a thick wall module 110 and a thin wall module 150 can form any angle with respect to one another when both are secured to a vertical connection post 300. By way of non-limiting example, a thick wall module 110 and a thin wall module 150 can form a 30, 45, 60, 75, 90, 105, 120, 135, 150, 165, or 180 degree angle with respect to one another when both the thin wall module 150 and the thick wall module 110 are attached to a vertical connection post 300.

Figure 4A:
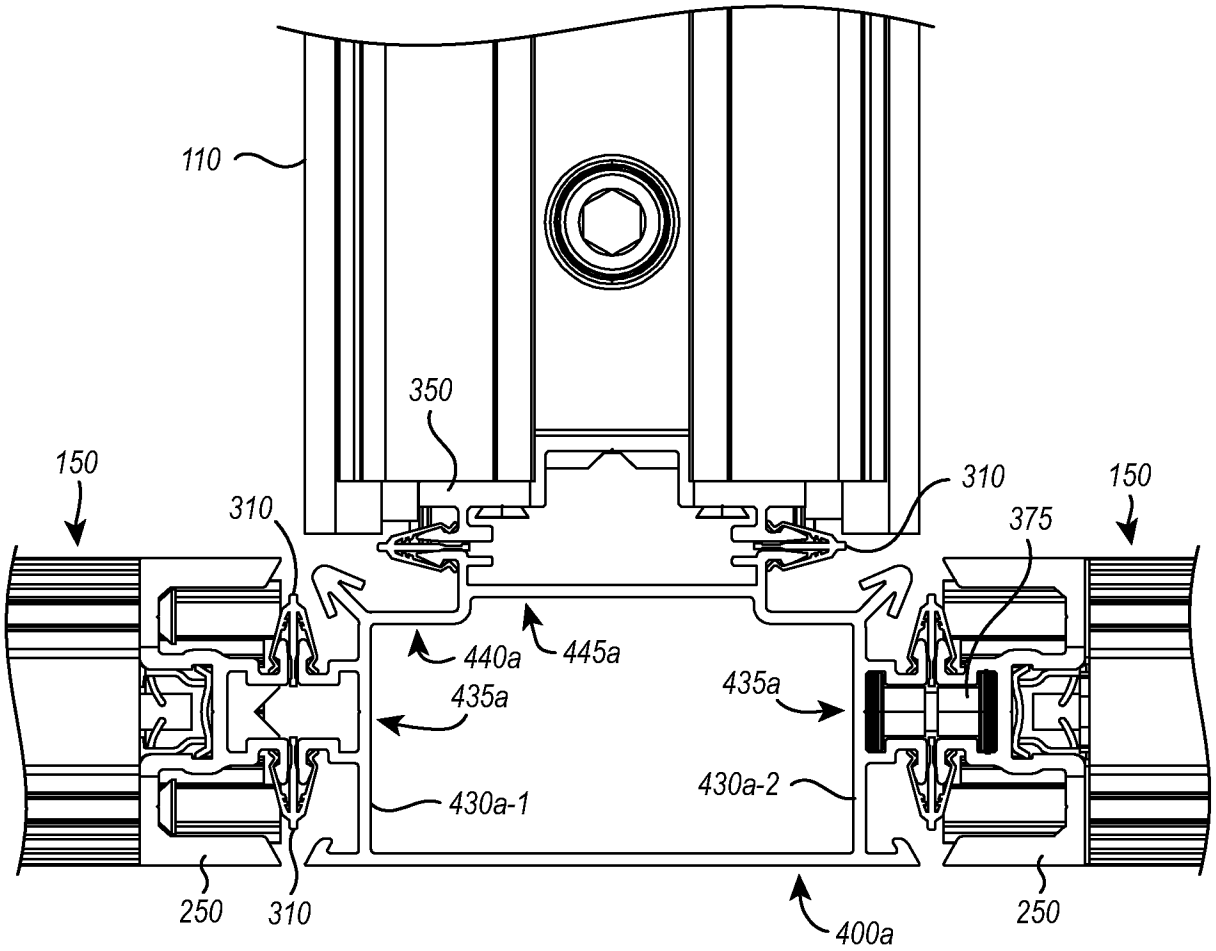
FIG. 4A illustrates a top view of a configuration of a thick wall module and two thin wall modules in a T-shaped arrangement in a pre-fabricated wall system, in accordance with implementations of the present disclosure.
Figure 4B:
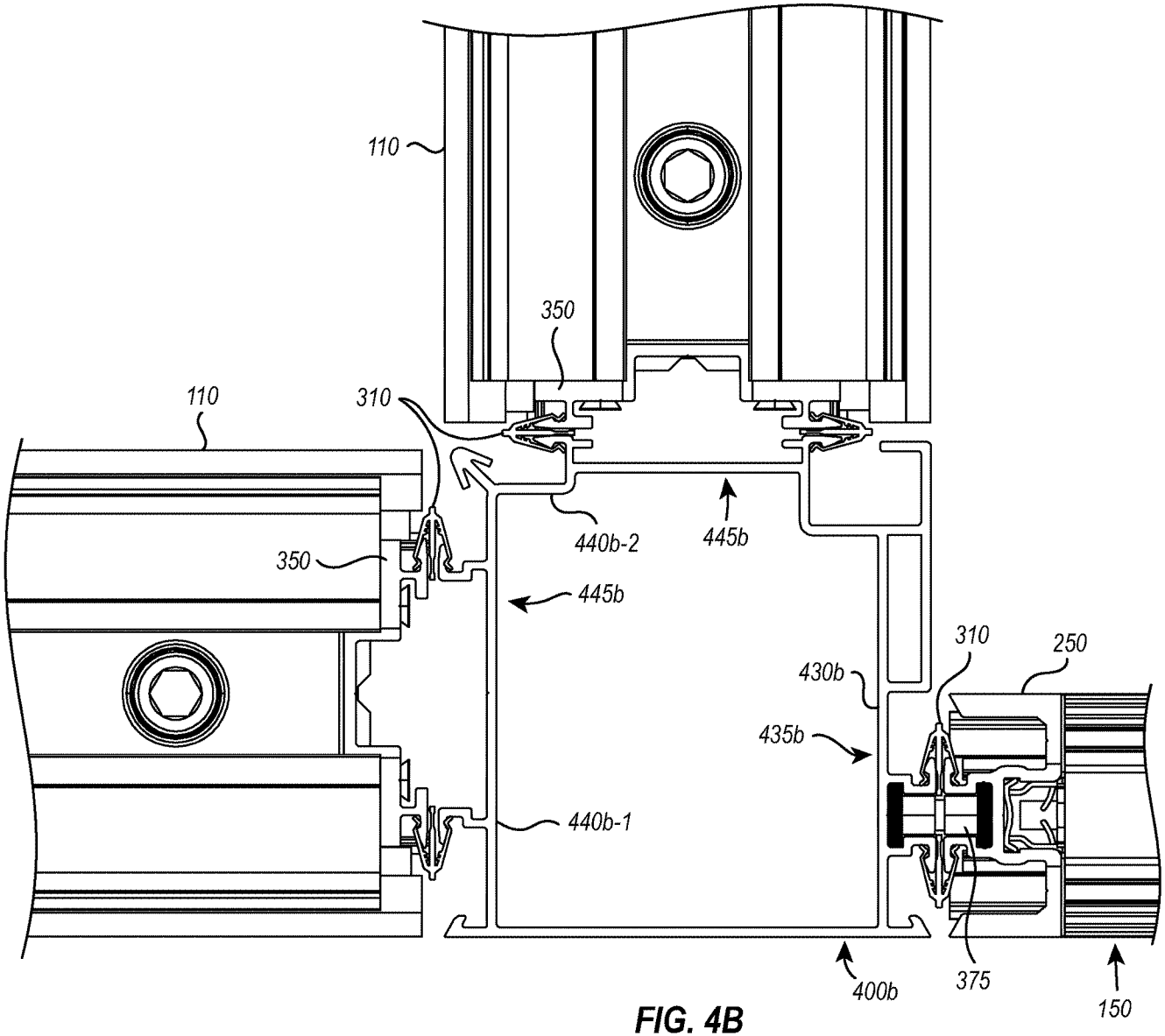
FIG. 4B illustrates a top view of a configuration of a thin wall module and two thick wall modules in a T-shaped arrangement in a pre-fabricated wall system, in accordance with implementations of the present disclosure.

FIGS. 4A-4B illustrate top views of various configurations of thin wall modules 150 and thick wall modules 110 joined together with a vertical post 400*a* for use in a pre-fabricated wall system. FIG. 4A shows an embodiment of a vertical connection post 400*a* that includes two connection interfaces 435*a* disposed on opposing sides 430*a*-1, 430*a*-2 of the vertical connection post 400*a* for securing to vertical end frames 250 of the thin wall modules 150 (e.g., via channel inserts 375 and/or connectors 310). The thin wall modules 150 can connect to the vertical connection post 400*a* to become arranged co-planar or parallel to one another when both of the thin wall modules 150 are connected to the vertical connection post 400*a*.

The vertical connection post 400*a* also includes a connection interface 445*a* disposed on a side 440*a* that is perpendicular to both of the opposing sides 430*a*-1, 430*a*-2. The connection interface 445*a* is configured for securing to the vertical end frame 350 of the thick wall module 110 (e.g., via connectors 310). Accordingly, a vertical connection post 400*a* can provide a T-shaped interface between two thin wall modules 150 and one thick wall module 110.

Those skilled in the art will recognize, in view of the present disclosure, that a vertical connection post 400 can provide a T-shaped interface between two thin wall modules 150 and one thick wall module 110 in configurations that are different than the arrangement illustrated in FIG. 4A. For instance, in at least one embodiment, the two thin wall modules 150 become arranged perpendicular to one another when both are secured to the vertical connection post 400*a*, and the thick wall module 110 becomes arranged perpendicular to one thin wall module 150 and co-planar or parallel to the other thin wall module 150 when connected to the vertical connection post 400*a*.

Furthermore, one will appreciate that a vertical connection post 400 can provide a T-shaped connection between two thick wall modules 110 and one thin wall module 150. For example. FIG. 4B shows an embodiment of a vertical connection post 400*b* that includes two connection interfaces 445*b* disposed on sides 440*b*-1, 440*b*-2 of the vertical connection post 400*b* that are perpendicular to one another. The connection interfaces 445*b* are configured for securing to vertical end frames 350 of the thick wall module 110 (e.g., via connectors 310). The thick wall modules 110 can connect to the vertical connection post 400*b* to become arranged perpendicular to one another when both of the thick wall modules 110 are connected to the vertical connection post 400*b*. In other embodiments, however, the thick wall modules 110 connect to the vertical connection post 400*b* to become arranged parallel or co-planar to one another when connected to the vertical connection post 400*b*.

FIG. 4B further illustrates that the vertical connection post 400*b* also includes a connection interface 435*b* disposed on a side 430*b* that is perpendicular to one side 440*b*-2 that includes a connection interface 445*b* and is co-planar or parallel to the other side 440*b*-1 that includes a connection interface 445*b*. The connection interface 435*b* is configured for securing to the vertical end frame 250 of the thin wall module 150 (e.g., via a channel insert 375 and/or connectors 310).

Accordingly, a vertical connection post 400*b* can provide a T-shaped interface between two thick wall modules 110 and one thin wall module 150. Although FIG. 4B illustrates an embodiment in which the two thick wall modules 110 form a right angle when secured to the vertical connection post 400*b*, those skilled in the art will recognize, in view of the present disclosure, that the thick wall modules 110 can become arranged parallel or co-planar to one another when both are secured to the vertical connection post 400*b*.

In addition, although FIGS. 4A and 4B illustrate vertical connection posts 400 providing for a T-shaped configuration of thick wall modules 110 and thin wall modules 150, one will note that a vertical connection post 400 can provide for an arrangement of thick wall modules 110 and thin wall modules 150 in which at least one wall module is not perpendicular or co-planar with at least one other wall module. For example, a vertical connection post 400 can connect to two perpendicular thick wall modules 110 and to one thin wall module 150 to form a 135-degree angle between the thin wall module 150 and each of the thick wall modules 110.

Furthermore, those skilled in the art will appreciate, in view of the present disclosure, that a vertical connection post as described herein can accommodate any number of thin wall modules 150 and thick wall modules 110. By way of non-limiting example, a vertical connection post can include four connection interfaces, with two of the connection interfaces being configured to connect to thin wall modules 150 and with the other two connection interfaces being configured to connect to thick wall modules 110.

Figure 5:
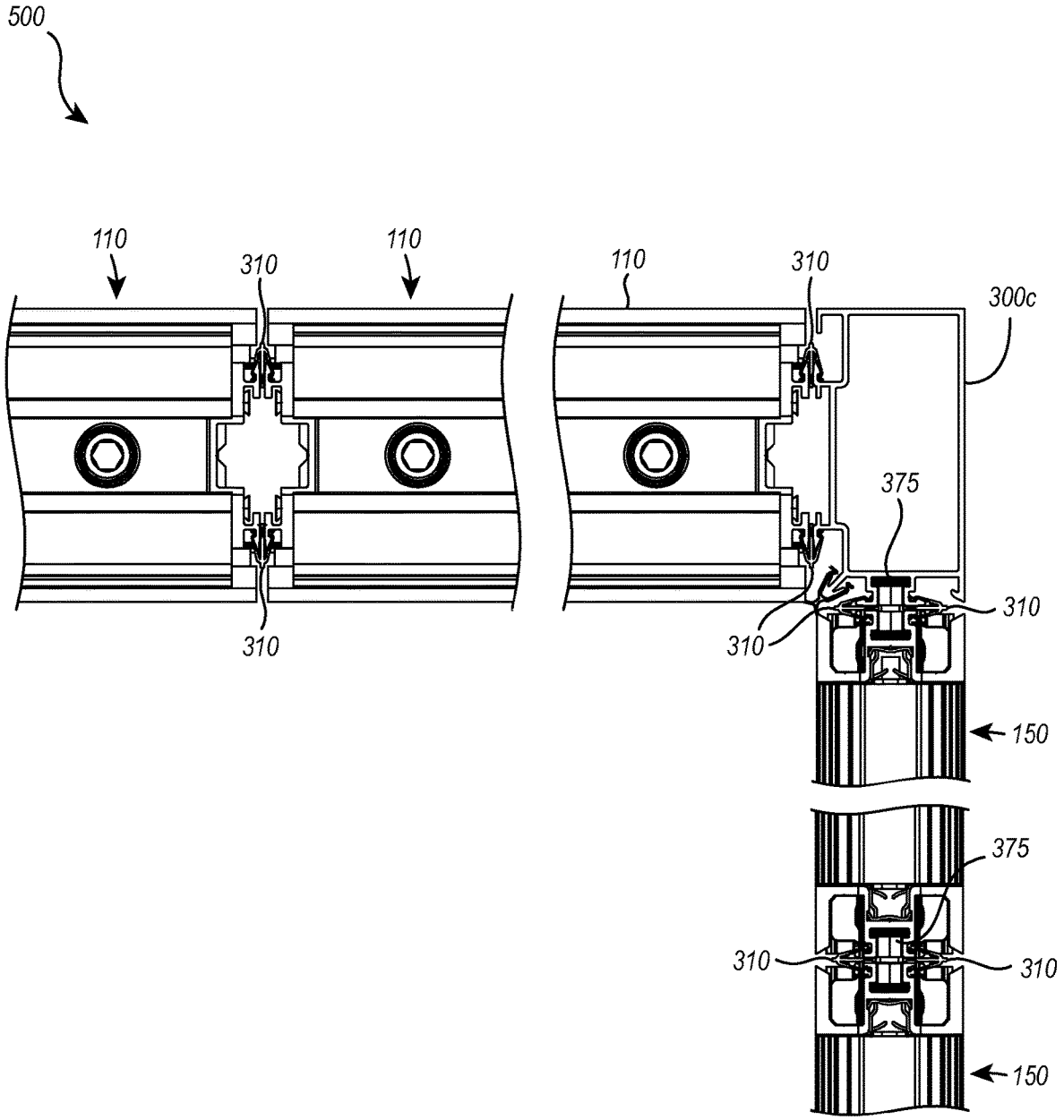
FIG. 5 illustrates a top view of a pre-fabricated wall system including various arrangements of thin wall modules joined with thick wall modules, in accordance with implementations of the present disclosure.

The present disclosure shows that thin and thick wall modules can be joined together at common vertical connection posts in a variety of configurations to accommodate the desired aesthetics and arrangements for diverse pre-fabricated wall system installation spaces. FIG. 5 illustrates a top view of a portion of a pre-fabricated wall system 500 including various arrangements of thin wall modules 150 joined with thick wall modules 110. For instance, the pre-fabricated wall system 500 includes a thick wall module 110 and a thin wall module 150 arranged perpendicular to one another and connected to a vertical connection post 300*c* (e.g., as illustrated and described herein with reference to FIG. 3C).

The pre-fabricated wall system 500 also includes a thick wall module 110 joined to another thick wall module 110 without a vertical connection post intervening therebetween. The thick wall modules 110 can be connected directly to one another via connectors 310. Similarly, the pre-fabricated wall system 500 includes a thin wall module 150 joined to another thin wall module 150 without a vertical connection post intervening therebetween. The thin wall modules 150 can be connected directly to one another via connectors 310 and/or channel inserts 375, as described hereinabove.

According to the present disclosure, a user of a pre-fabricated wall system can advantageously employ the same connectors 310 to secure a thick wall module 110 directly to another thick wall module 110 and to secure a thick wall module 110 to a vertical connection post 300, 400. Similarly, a user can employ the same connectors 310 and channel insert(s) 375 to secure a thin wall module 150 to another thin wall module and to secure a thin wall module 150 to a vertical connection post 300, 400. Enabling users to utilize common connectors and/or channel inserts to facilitate the connections between thick wall modules 110, thin wall modules 150, and vertical connection posts 300, 400 may simplify the process for installing a pre-fabricated wall system and may reduce manufacturing complexities by reducing the number of different connection elements needed in a pre-fabricated wall system.

Although the foregoing description has focused in some ways on vertical connection posts for joining thick wall modules with thin wall modules at vertical interfaces, those skilled in the art will recognize, in view of the present disclosure, that horizontal connection posts can be used to join thick wall modules with thin wall modules at horizontal interfaces, and a horizontal connection post can include features similar to those described herein referring to vertical connection posts.

The foregoing description and Figures illustrate features, properties, details, implementations, and variations of pre-fabricated wall systems having thick and thin walls, and components thereof. One will appreciate, in view of the present disclosure, that various embodiments of pre-fabricated wall systems having thick and thin walls, and components thereof, can include any combination of the various features, properties, details, etc. described hereinabove.

In a first embodiment, a pre-fabricated wall system that joins wall modules of different thicknesses includes a thin wall module 150 having a depth defined by a distance from a front face thereof to a back face thereof, a thick wall module 110 having a depth that is greater than the depth of the thin wall module 150, and a vertical connection post 300. The vertical connection post 300 includes a first connection interface 335 on a first side 330 configured to secure to the thin wall module 150, and a second connection interface 345 on a second side 340 opposite the first side 330 configured to secure to the thick wall module. The thin wall module 150 and the thick wall module 110 are arranged parallel or co-planar to one another when both the thin wall module 150 and the thick wall module 110 are secured to the vertical connection post 300.

The thin wall module includes a wall tile 155 and a vertical end frame 250 connected to a vertical edge of the wall tile 155, and the vertical end frame has a channel 255. The first connection interface 335 also has a channel 355.

The pre-fabricated wall system includes a channel insert 375 configured to reside within both the channel 255 of the vertical end frame 250 and the channel 355 of the first connection interface 335, and the channel insert 375 secures the thin wall module to the vertical connection post.

The channel 255 of the vertical end frame 250 of the thin wall module 150 has a channel protrusion 285 that is configured to align with a channel protrusion 385 of the channel 355 of the first connection interface 335. The pre-fabricated wall system also has a connector 310 configured to fit over at least a portion of the channel protrusion 285 of the vertical end frame 250 and the channel protrusion 385 of the first connection interface 335 to secure the thin wall module 150 to the vertical connection post 300. The connector 310 is also configured to fit over at least a portion of a connection protrusion 347 of the thick wall module 110 and a corresponding protrusion 353 on the second connection interface 345, and the connector 310 can secure the thick wall module 110 to the vertical connection post 300.

In a second embodiment, the pre-fabricated wall system corresponds to the pre-fabricated wall system of the first embodiment, and further includes a plurality of connectors.

In a third embodiment, the pre-fabricated wall system corresponds to the pre-fabricated wall system of the first embodiment, and the connector additionally comprises a seal configured to fill a gap formed between the thin wall module and the vertical connection post when the thin wall module is secured to the vertical connection post, or a gap formed between the thick wall module and the vertical connection post when the thick wall module is secured to the vertical connection post.

In a fourth embodiment, the pre-fabricated wall system corresponds to the pre-fabricated wall system of the first embodiment, and the thick wall module comprises an interior cavity sized to house electrical wiring.

In a fifth embodiment, the pre-fabricated wall system corresponds to the first pre-fabricated wall system of the embodiment, but rather than the thin wall module and the thick wall module being arranged parallel or co-planar to one another, the thin wall module and the thick wall module are arranged non-parallel to one another when both the thin wall module and the thick wall module are secured to the vertical connection post.

In a sixth embodiment, the pre-fabricated wall system corresponds to the pre-fabricated wall system of the fifth embodiment, and the thin wall module and the thick wall module form a right angle when both are secured to the vertical connection post.

In a seventh embodiment, the pre-fabricated wall system corresponds to the pre-fabricated wall system of the sixth embodiment, and the vertical connection post further comprises a corner protrusion, and the corner protrusion receives a seal for sealing a gap formed between the thin wall module and the thick wall module when both the thin wall module and the thick wall module are secured to the vertical connection post.

In an eighth embodiment, a pre-fabricated wall system includes a plurality of wall modules. A thickness of each of the wall modules is defined by a distance between a front face of each wall module and a back face of each wall module. Furthermore, at least two of the plurality of wall modules have different thicknesses. The pre-fabricated wall system also includes a vertical connection post comprising a plurality of connection interfaces configured for securing to each of the plurality of wall modules, including the at least two of the plurality of wall modules that have different thicknesses.

In a ninth embodiment, the pre-fabricated wall system corresponds to the pre-fabricated wall system of the eighth embodiment, with the plurality of wall modules comprising two thick wall modules and one thin wall module. The thick wall modules have a thickness that is greater than a thickness of the thin wall module, and the connection interfaces of the plurality of connection interfaces are arranged on the vertical connection post such that the two thick wall modules form a right angle when secured to the vertical connection post.

In a tenth embodiment, the pre-fabricated wall system corresponds to the pre-fabricated wall system of the eighth embodiment, with the plurality of wall modules comprising two thick wall modules and one thin wall module. The thick wall modules have a thickness that is greater than a thickness of the thin wall module, and the connection interfaces of the plurality of connection interfaces are arranged on the vertical connection post such that the two thick wall modules are co-planar when secured to the vertical connection post.

In an eleventh embodiment, the pre-fabricated wall system corresponds to the pre-fabricated wall system of the eighth embodiment, with the plurality of wall modules comprising one thick wall module and two thin wall modules. The thick wall module has a thickness that is greater than a thickness of the thin wall modules, and the connection interfaces of the plurality of connection interfaces are arranged on the vertical connection post such that the two thin wall modules form a right angle when secured to the vertical connection post.

In a twelfth embodiment, the pre-fabricated wall system corresponds to the pre-fabricated wall system of the eighth embodiment, with the plurality of wall modules comprising one thick wall module and two thin wall modules. The thick wall module has a thickness that is greater than a thickness of the thin wall modules, and the connection interfaces of the plurality of connection interfaces are arranged on the vertical connection post such that the two thin wall modules are co-planar when secured to the vertical connection post.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present disclosure may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes which come within the meaning and range of equivalency of the claims are to be embraced within their scope.

What is claimed is:

1. A pre-fabricated wall system that joins wall modules of different thicknesses, comprising:

a thin wall module having a depth defined by a distance from a front face thereof to a back face thereof;

a thick wall module having a depth that is greater than the depth of the thin wall module; and a vertical connection post comprising:

a first connection interface on a first side configured to secure to the thin wall module;

a second connection interface on a second side opposite the first side configured to secure to the thick wall module;

a first channel insert configured to reside within the first connection interface and to secure to the thin wall module; and a second channel insert configured to reside within the second connection interface and to secure to the thick wall module;

wherein:

the first channel insert secures the thin wall module to the vertical connection post;

the second channel insert secures the thick wall module to the vertical connection post;

the thin wall module and the thick wall module are arranged parallel or co-planar to one another when both the thin wall module and the thick wall module are secured to the vertical connection post; and the thin wall module comprises: a wall tile; and a vertical end frame connected to a vertical edge of the wall tile, the vertical end frame comprising a channel.

2. The pre-fabricated wall system of claim 1, wherein:
the first connection interface is positioned on the first side; and
a face of the thin wall module and a face of the thick wall module are co-planar when both the thin wall module and the thick wall module are secured to the vertical connection post.

3. The pre-fabricated wall system of claim 1, wherein:
the first connection interface is positioned on the first side; and
center planes of both the thin wall module and the thick wall module are aligned when both the thin wall module and the thick wall module are secured to the vertical connection post.

4. The pre-fabricated wall system of claim 1, wherein the first connection interface comprises a channel.

5. The pre-fabricated wall system of claim 4 wherein:
the first channel insert is configured to reside within both the channel of the vertical end frame and the channel of the first connection interface;
the second channel insert is configured to reside within both the channel of the vertical end frame and the channel of the second connection interface; and
the channel insert secures the thin wall module to the vertical connection post.

6. The pre-fabricated wall system of claim 4, wherein:
the channel of the vertical end frame of the thin wall module has a channel protrusion that is configured to align with a channel protrusion of the channel of the first connection interface.

7. The pre-fabricated wall system of claim 6, further comprising:
a connector configured to fit over at least a portion of the channel protrusion of the vertical end frame and the channel protrusion of the first connection interface to secure the thin wall module to the vertical connection post.

8. The pre-fabricated wall system of claim 7, wherein:
the connector is configured to fit over at least a portion of a connection protrusion of the thick wall module and a corresponding protrusion on the second connection interface; and
the connector secures the thick wall module to the vertical connection post.

9. The pre-fabricated wall system of claim 8, wherein the connector comprises a seal configured to fill:
a gap formed between the thin wall module and the vertical connection post when the thin wall module is secured to the vertical connection post, or
a gap formed between the thick wall module and the vertical connection post when the thick wall module is secured to the vertical connection post.

10. The pre-fabricated wall system of claim 7, further comprising a plurality of connectors.

11. The pre-fabricated wall system of claim 1, wherein the thick wall module comprises an interior cavity sized to house electrical wiring.

12. A pre-fabricated wall system that joins walls of different thicknesses, comprising:
a thin wall module having a depth defined by a distance from a front face thereof to a back face thereof;
a thick wall module having a depth that is greater than the depth of the thin wall module; and
a vertical connection post comprising:
a first connection interface on a first side configured to secure to the thin wall module; and
a second connection interface on a second side configured to secure to the thick wall module;
wherein:
the thin wall module and the thick wall module are arranged non-parallel to one another when both the thin wall module and the thick wall module are secured to the vertical connection post; and
the vertical connection post comprises a corner protrusion that receives a seal for sealing a gap formed between the thin wall module and the thick wall module when both the thin wall module and the thick wall module are secured to the vertical connection post.

13. The pre-fabricated wall system of claim 12, wherein the thin wall module and the thick wall module form a right angle when both are secured to the vertical connection post.

14. A pre-fabricated wall system, comprising:
a plurality of wall modules, wherein:
a thickness of each of the wall modules is defined by a distance between a front face of each wall module and a back face of each wall module; and
at least two of the plurality of wall modules have different thicknesses;
a vertical connection post comprising a plurality of connection interfaces configured for securing to each of the plurality of wall modules, including the at least two of the plurality of wall modules that have different thicknesses; and
channel inserts securing the vertical connection post to the wall modules;
wherein:
the vertical connection post and the wall modules each include a vertical channel, and
the channel inserts reside within the vertical channels to secure the vertical connection post to the wall modules.

15. The pre-fabricated wall system of claim 14, wherein:
the plurality of wall modules comprises two thick wall modules and one thin wall module, the thick wall modules having a thickness that is greater than a thickness of the thin wall module; and
the connection interfaces of the plurality of connection interfaces are arranged on the vertical connection post such that the two thick wall modules form a right angle when secured to the vertical connection post.

16. The pre-fabricated wall system of claim 14, wherein:
the plurality of wall modules comprises two thick wall modules and one thin wall module, the thick wall modules having a thickness that is greater than a thickness of the thin wall module; and
the connection interfaces of the plurality of connection interfaces are arranged on the vertical connection post such that the two thick wall modules are co-planar when secured to the vertical connection post.

17. The pre-fabricated wall system of claim 14, wherein:
the plurality of wall modules comprises one thick wall module and two thin wall modules, the thick wall module having a thickness that is greater than a thickness of the thin wall modules; and
the connection interfaces of the plurality of connection interfaces are arranged on the vertical connection post such that the two thin wall modules form a right angle when secured to the vertical connection post.

18. The pre-fabricated wall system of claim 14, wherein:
the plurality of wall modules comprises one thick wall module and two thin wall modules, the thick wall module having a thickness that is greater than a thickness of the thin wall modules; and the connection interfaces of the plurality of connection interfaces are arranged on the vertical connection post such that the two thin wall modules are co-planar when secured to the vertical connection post.

* * * * *